US010784628B2

(12) United States Patent
Wittmann

(10) Patent No.: US 10,784,628 B2
(45) Date of Patent: Sep. 22, 2020

(54) ELECTRICAL PLUG CONNECTOR

(71) Applicant: Robert Bosch GmbH, Stuttgart (DE)

(72) Inventor: Rolf Wittmann, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/256,442

(22) Filed: Jan. 24, 2019

(65) Prior Publication Data

US 2019/0229469 A1 Jul. 25, 2019

(30) Foreign Application Priority Data

Jan. 25, 2018 (DE) ..... 10 2018 201 178

(51) Int. Cl.

| | |
|---|---|
| ***H01R 13/6582*** | (2011.01) |
| ***H01R 24/40*** | (2011.01) |
| ***H01R 13/6581*** | (2011.01) |
| ***H01R 13/639*** | (2006.01) |
| ***H01R 13/05*** | (2006.01) |
| ***H01R 13/6592*** | (2011.01) |
| ***H01R 13/6599*** | (2011.01) |

(52) U.S. Cl.

CPC ..... *H01R 13/6582* (2013.01); *H01R 13/05* (2013.01); *H01R 13/639* (2013.01); *H01R 13/6581* (2013.01); *H01R 13/6592* (2013.01); *H01R 13/6599* (2013.01); *H01R 24/40* (2013.01); *H01R 2201/04* (2013.01); *H01R 2201/26* (2013.01)

(58) Field of Classification Search

CPC ..... H01R 13/6599; H01R 13/6592; H01R 13/6582; H01R 13/05; H01R 2201/04; H01R 2201/26; H01R 24/40

See application file for complete search history.

(56) References Cited

U.S. PATENT DOCUMENTS 4,863,401 A * 9/1989 Talend ..... H01R 13/7197 439/607.43
5,267,882 A * 12/1993 Davis ..... H01R 13/64 439/680
5,417,590 A * 5/1995 Dechelette ..... H01R 13/64 439/607.48
6,142,828 A * 11/2000 Pepe ..... H01R 13/6592 439/607.43

(Continued)

FOREIGN PATENT DOCUMENTS

CN 101465492 A 6/2009
DE 19935994 A1 2/2001

*Primary Examiner* — Briggitte R. Hammond

(74) *Attorney, Agent, or Firm* — Norton Rose Fulbright US LLP; Gerard Messina

(57) ABSTRACT

An electrical plug connector. The electrical plug connector has: a connector housing for accommodating at least one electrical cable that extends along an axial direction; a shielding plate that completely encloses the connector housing in a circumferential direction around the axial direction. The connector housing has, on an external surface, a play-limiting element for limiting a degree of play in the state plugged together with the mating plug connector. The shielding plate has an opening, the play-limiting element protruding from the connector housing and extending through the opening of the shielding plate and/or the play-limiting element being fashioned as a connector housing opening in the connector housing and being adjacent to the opening.

15 Claims, 1 Drawing Sheet

(56) References Cited

U.S. PATENT DOCUMENTS

| | | | | |
|---|---|---|---|---|
| 6,210,231 | B1 * | 4/2001 | Lai | H01R 13/6581 439/606 |
| 6,231,392 | B1 * | 5/2001 | van Woensel | H01R 13/5808 439/353 |
| 6,565,388 | B1 * | 5/2003 | Van Woensel | H01R 13/514 439/607.48 |
| 6,666,719 | B1 | 12/2003 | Kuroi et al. | |
| 7,909,646 | B2 * | 3/2011 | Feldman | H01R 9/0512 439/108 |
| 9,106,021 | B2 * | 8/2015 | Patel | H01R 13/6466 |
| 2009/0186529 | A1 | 7/2009 | Chiang | |
| 2014/0017926 | A1 | 1/2014 | Wu et al. | |
| 2014/0154921 | A1 * | 6/2014 | Qi | H01R 13/6581 439/620.03 |
| 2015/0079845 | A1 * | 3/2015 | Wanha | H01R 13/6477 439/607.41 |
| 2016/0268703 | A1 * | 9/2016 | Jager | H01R 4/2454 |
| 2017/0352452 | A1 * | 12/2017 | Nonen | H01B 3/305 |
| 2018/0351305 | A1 * | 12/2018 | Maesoba | H01B 11/1895 |

* cited by examiner

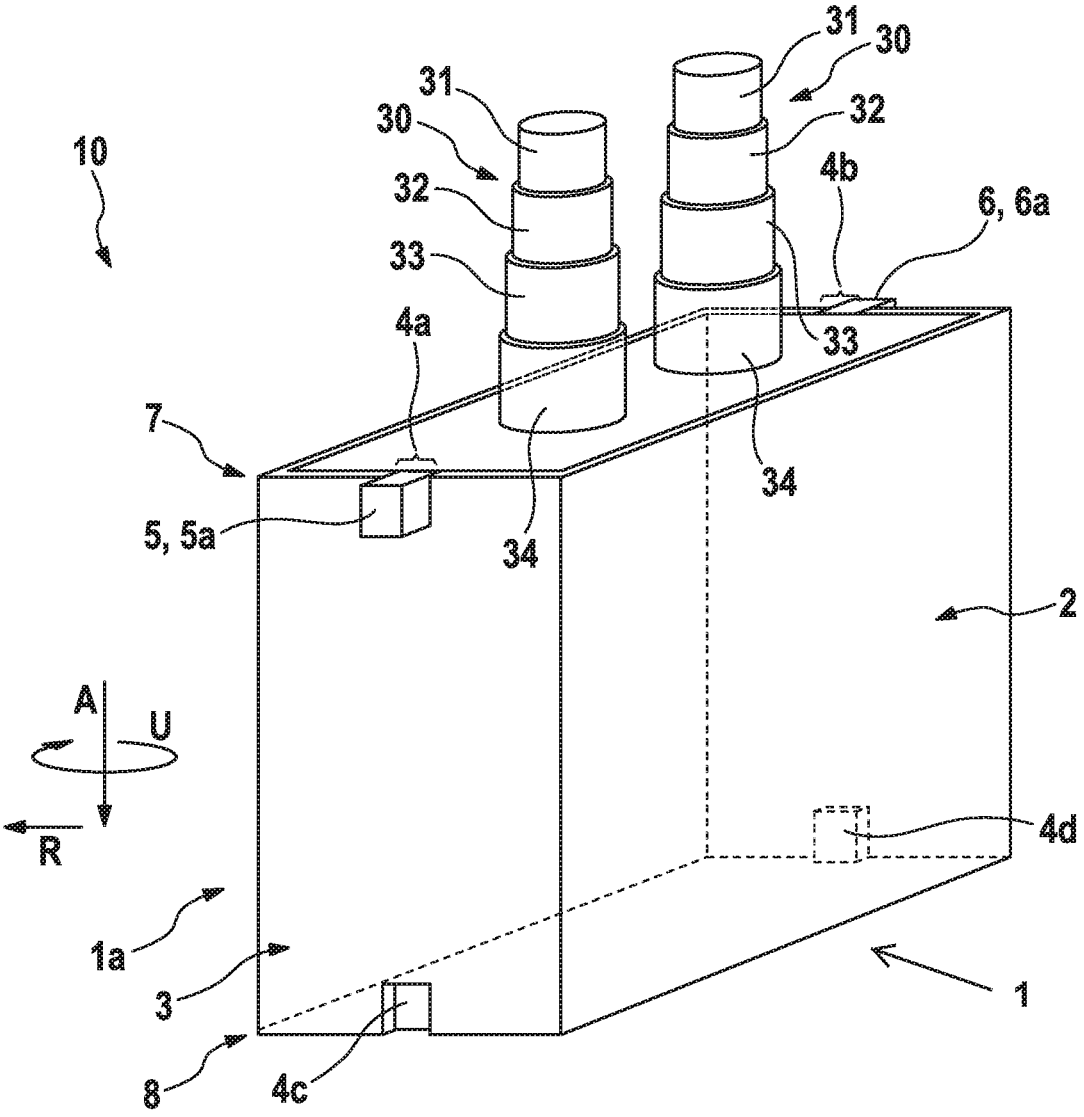
10
31
30
32
33
4a
7
5, 5a
34
31
30
32
4b
6, 6a
33
34
2
A
U
R
4d
1a
3
8
4c
1

ELECTRICAL PLUG CONNECTOR

CROSS REFERENCE

The present application claims the benefit under 35 U.S.C. § 119 of German Patent Application No. DE 102018201178.8 filed on Jan. 25, 2018, which is expressly incorporated herein by reference in its entirety.

FIELD

The present invention relates to an electrical plug connector.

BACKGROUND INFORMATION

From the related art, electrical plug connectors are available that are intended to be plugged together with a mating plug connector. For example in the automotive field, in connection with the greater networking and increasing number of sensors, e.g., for realizing autonomously driving automobiles, such plug connectors are becoming increasingly significant for data transmission lines, e.g., Ethernet connections. Plug connectors are also increasingly used to transmit high electrical currents of at least 10 A.

In this context, for example when there are high data transmission rates or high currents or in the case of plug connectors situated close to such lines, in addition to shielding the lines it is also necessary to extend the shielding into the area of the plug connector, and to enclose the plug connector housing with a plate part, or shielding plate. In this way, the so-called EMC (electromagnetic compatibility) can be improved. In other words, an influencing of signals in a cable does not cross over to other electrical or electronic elements, and, conversely, signals in a cable are not influenced by electromagnetic radiation from other components. This holds as well for specific embodiments in which, for example in Ethernet plug connectors, individual Ethernet connections in shielded housing parts are to be placed into a larger housing, or in systems used for the transmission of high currents.

German Patent Application No. DE 199 35 994 A1 describes an electrical plug connector for producing pluggable data connection lines, having a shielding plate.

SUMMARY

In accordance with the present invention, in order to meet higher demands with regard to vibration, it is advantageous to limit, or to set in a defined fashion, or to completely eliminate, e.g., by a press fit, the play between the connector housing and a male multipoint connector or individual plug of a mating connector corresponding to the plug connector. Here, depending on the application, the case may occur in which the same plug connection is to be used for example for high or low data transmission rates, or for high or low currents. A cost advantage can be achieved by omitting the shielding plate for applications having low EMC requirements. However, such an omission of the shielding plate influences the outer contour of the connector housing, in that it reduces its outer dimensions, and to that extent has an influence on behavior in the interface.

The need may therefore arise for the provision of an electrical plug connector for plugging together with a complementary mating plug connector, the plug connector having a shielding plate, but in which the plug connector can optionally also be used without the shielding plate when the EMC requirements are low, and which plug connector can be plugged together with a corresponding mating plug connector to form a plug connector system. In the plugged-together state of the plug connector and mating plug connector, a degree of play, or a pressing of the connector housing of the plug connector in the interface, or in a housing of the mating plug connector, is intended to be independent of the use of a shielding plate at the plug connector.

This requirement can be met in accordance with example embodiments of the present invention. Advantageous specific embodiments of the present invention are described herein.

According to a first aspect of the present invention, an electrical plug connector is provided for plugging together with a complementary mating plug connector. The plug connector is designed to be plugged together with a mating plug connector; this then yields a plug connector system. The plug connector has:

- a connector housing for accommodating at least one electrical cable that extends along an axial direction;
- a shielding plate that completely surrounds the connector housing in a circumferential direction around the axial direction.

It is provided that the connector housing has, on an external surface, a play-limiting element for limiting a degree of play in the state plugged together with the mating plug connector, the shielding plate having an opening, the play-limiting element protruding from the connector housing and extending through the opening of the shielding plate. Alternatively or in addition, it is provided that the play-limiting element is designed as an opening in the connector housing and is adjacent to the opening in the shielding plate.

Through the provision of the play-limiting element, accessible despite the shielding plate, on the connector housing, a degree of play, or a pressing of the connector housing, can be set in a defined manner and minimized, in a state plugged together with a mating plug connector (i.e., when a plug connector system of the plug connector and mating plug connector is formed), independent of the use of a shielding plate. If the plug connector is used with the shielding plate, then, through the opening provided in the shielding plate, it is ensured that the shielding effect of the shielding plate is not substantially reduced.

Due to the possibility of using the plug connector without the shielding plate, the plug connector can advantageously be produced simply and at low cost as a system that can be used in modular fashion, while nonetheless being able to withstand increased mechanical loads (e.g., vibrations or changing temperatures) in the state plugged together with a mating plug connector. Of course, even with the shielding plate the plug connector also has a defined low degree of play in the state plugged together with the mating plug connector.

For example, the opening in the shielding plate can have a surface of at most 10 $mm^2$ or at most 2 $mm^2$ or at most 1 $mm^2$ or at most 0.5 $mm^2$ or at most 0.2 $mm^2$. The opening in the shielding plate can for example have a rectangular or quadratic shape. It can be fashioned for example as a type of slot in the shielding plate. The opening can have an introductory bevel or introductory funnel, so that during installation on the connector housing the shielding plate can for example be plugged onto the connector housing, surrounding the play-limiting element easily, in self-centering fashion, and with a precise fit.

For example, the play-limiting element can be fashioned as a pin. This pin can for example interact with a corresponding opening or groove of a mating connector housing of a mating plug connector, for example by being received in such an opening or groove with a nonpositive fit or frictional fit. Interaction with a surface (made with a precise tolerance) of a mating connector housing of a mating plug connector is also possible.

In this way, in the plugged-together state a degree of play in the axial and radial direction, and in the circumferential direction, between the plug connector and the mating plug connector can advantageously be limited.

Alternatively or in addition, if the play-limiting element is realized as an opening in the connector housing, this opening can interact with a corresponding mating connector play-limiting element, e.g., with a pin that protrudes from the mating connector housing.

Generally, the play-limiting element can be designed both as a protrusion, e.g., a pin, and as an opening in the connector housing, such that the protrusion and opening are situated alongside one another, e.g., regarded in the circumferential direction, and are allocated to the same opening in the shielding plate. In this way, with a corresponding opening-protrusion combination on a mating connector housing, a particularly stable and secure limitation of play can be brought about in the plugged-together state.

Through the defined positioning and formation (e.g., length, width, thickness, shape) of the play-limiting element on the connector housing, in addition a poka-yoke solution can be created that prevents an incorrect plugging together of the plug connector and the mating plug connector, or the plugging of the plug connector together with a mating plug connector not intended for it.

Due to the fact that the plug connector has at least one electrical cable that is shielded and is situated in the connector housing, a particularly high-performance plug connector is provided that is designed so as to be particularly robust against mechanical loads (e.g., vibrations) and free of loose connections, and is particularly well protected against EMC influences.

The plug connector can for example be designed to be suitable for use for the transmission of data rates of at least 100 Mbit/s or at least 1 Gbit/s or at least 100 GBit/s.

Alternatively or in addition, the plug connector can be designed so as to be suitable e.g. for use in high-current applications for transmitting electrical currents of at least 10 A, or at least 50 A, or even at least 100 A.

A development in accordance with the present invention provides that the connector housing has, on its external surface, an additional play-limiting element for limiting a degree of play in the state plugged together with the mating plug connector, the shielding plate having an additional opening, the additional play-limiting element protruding from the connector housing and extending through the additional opening of the shielding plate. Alternatively or in addition, it is provided that the additional play-limiting element is designed as an additional opening in the connector housing, and is adjacent to the additional opening in the shielding plate.

In this way, the absence of play is advantageously further improved. This is because through the provision of two play-limiting elements a degree of play between the plug connector and the mating plug connector in the form of a rotation about the axial direction, i.e., in the circumferential direction, is particularly effectively limited. Here it is not significant whether the plug connector is used with or without a shielding plate, because the play is set or limited by the play-limiting elements.

Due to the fact that the connector housing is made of plastic, or electrically non-conductive plastic, the plug connector can be produced particularly easily and at low cost.

For example, the connector housing can include a plastic, in particular in a predominant portion, selected from the group polyamide, polypropylene, polyethylene, etc.

The situation of the play-limiting element at a first distal end of the connector housing, regarded along the axial direction, it being also possible to situate an additional play-limiting element at the first distal end, advantageously brings it about that the shielding effect of the shielding plate is impaired to a particularly small degree. For example, in this way the shielding can also be taken over by an additional shielding of the mating plug connector, and can cover the opening or openings. At the same time, in this way when the plugging together with the mating plug connector takes place it can immediately be confirmed haptically whether the plug connector and the mating plug connector fit with one another (poka-yoke).

Due to the fact that the additional play-limiting element is situated on the connector housing so as to be offset by 160° to 200° relative to the play-limiting element, regarded in the circumferential direction, a particularly good limitation of play, e.g., relative to a rotation around the axial direction or transverse to the axial direction, is advantageously brought about even given only small geometrical dimensions of the two play-limiting elements.

Due to the fact that the opening in the shielding plate tightly surrounds the play-limiting element, and for example an additional opening of the shielding plate tightly surrounds an additional play-limiting element, the shielding effect of the shielding plate is impaired to a particularly small degree.

Here, the opening in the shielding plate can for example be made at most 1 mm or at most 0.5 mm or at most 0.1 mm wider (in the radial direction) and/or higher (in the axial direction) than the dimensions of the play-limiting element. This holds analogously for the additional opening relative to the dimensions of the additional play-limiting element.

Due to the fact that the shielding plate has, at a second distal end situated opposite the first distal end, at least one third opening for accepting a mating connector play-limiting element of a mating connector that can be connected to the plug connector, a particularly good limitation of play and a particularly high degree of robustness against vibrations are advantageously brought about.

In particular, in this way a degree of play relative to tilting movements can be advantageously reduced in the plugged-together state. This holds both when the shielding plate is installed and when the shielding plate is not installed.

It is also possible for the shielding plate to have, at the second distal end, a fourth opening for accepting an additional mating connector play-limiting element of a mating connector that can be connected to the plug connector. This fourth opening, and the additional mating connector play-limiting element, can be situated so as to be offset, regarded in the circumferential direction, e.g. by 160° to 200° relative to the third opening and to the mating connector play-limiting element.

BRIEF DESCRIPTION OF THE DRAWINGS

Additional features and advantages of the present invention will be clear to those skilled in the art from the description below of an exemplary specific embodiment, which however is not to be interpreted as limiting the present invention, with reference to the FIGURE.

FIG. 1 shows a schematic perspective representation of an electrical plug connector.

DETAILED DESCRIPTION OF EXAMPLE EMBODIMENTS

FIG. 1 shows as an example an electrical plug connector 10 for producing pluggable data connection lines. Plug connector 10 has a (here two-poled) connector housing 1. Here connector housing 1 has, merely as an example, an essentially rectangular cross-sectional surface. However, round, elliptical, hexagonal, or other cross-sectional shapes are also possible.

Plug connector 10 is designed to be plugged together or assembled with a mating plug connector (not shown here) to form a plug connector system.

A direction of assembly in which plug connector 10 is plugged together with the mating plug connector (not shown) to form a plug connector system is indicated by the arrow running in axial direction A. In this way, the mating plug connector in the FIGURE would be situated below plug connector 10, and for example pins or contact blades of the mating plug connector can be plugged from below (in the FIGURE) into contact openings (not shown) in plug connector 10, or into connector housing 1.

A circumferential direction U runs around axial direction A. A radial direction R extends transverse to axial direction A.

In connector housing 1, there are situated two electrical cables 30 that in the FIGURE run upward going out from connector housing 1. Each of the two cables 30 has an electrically conductive conductor 31, an insulation 32, and, optionally, a (single-conductor) shielding 33 surrounding insulation 31, as found for example in conventional Ethernet plugs with connected Ethernet cable. In the FIGURE, cable 30 is shown with (single-conductor) shielding 33. The shielding is additionally surrounded by an outer insulation 34.

In addition, plug connector 10 has a shielding plate 2 that completely surrounds connector housing 1 in circumferential direction U, i.e., surrounds it circumferentially or in annular fashion. The (single-conductor) shielding 33 is connected to shielding plate 2 in electrically conductive fashion (not shown).

Connector housing 1 has, at a first distal end 7 (at top in the FIGURE), on an external surface 1*a*, a play-limiting element 5 and an additional play-limiting element 6 for limiting a degree of play in the state plugged together with a mating plug connector (not shown). The two play-limiting elements 5, 6 are here fashioned as pin 5*a* and additional pin 6*a*. Regarded in circumferential direction U, they are configured offset to one another by approximately 180° on external surface 1*a* of connector housing 1.

On an end face 3, or on external surface 1*a* of connector housing 1, shielding plate 2 has, at the first distal end 7 (at top in the FIGURE), an opening 4*a* and an additional opening 4*b*.

Here, play-limiting element 5 and additional play-limiting element 6 protrude from connector housing 1 and extend through opening 4*a* or through additional opening 4*b* of shielding plate 2.

The two play-limiting elements 5, 6, extending through opening 4*a* and additional opening 4*b*, make it possible to set the degree of play or the pressing between connector housing 1 and a corresponding mating connector housing (not shown) independent of the presence of shielding plate 2. In other words: in the depicted plug connector 10, shielding plate 2 around connector housing 2 could also be done without when the EMC requirements are low. However, this would then reduce the outer dimensions of the plug connector, and, without play-limiting elements 5, 6, in the plugged-together state with the mating plug connector excessive play would possibly occur as a result. However, the depicted plug connector 10 always has only a small degree of play in the plugged-together state, and can therefore be used in modular fashion with or without shielding plate 2.

According to this design, on connector housing 1 corresponding play-limiting elements can also be attached at a second distal end 8 that faces away from first distal end 7, in order to set the play or pressing perpendicular to axial direction A, in axial direction A, and in circumferential direction U. Here, all the play-limiting elements can protrude from connector housing 1 (e.g. as pins) and/or can be realized as connector housing openings in which a protruding element of the mating connector housing can be received.

At second distal end 8, a third opening 4*c* is made in shielding plate 2, after which opening, seen in radial direction R, here a third play-limiting element (without reference character) is situated that is realized as a connector housing opening. In the same way, at second distal end 8, a fourth opening 4*d* is situated in shielding plate 2, offset by 180° relative to the third opening 4*c*, regarded in circumferential direction U. Corresponding to this, after this fourth opening, seen in radial direction R, there is situated a fourth play-limiting element (without reference character) realized as a connector housing opening.

Openings 4*a*, 4*b*, 4*c*, 4*d* of shielding plate 2 in the exemplary embodiment are realized so as to be substantially rectangular or quadratic. Merely as examples, here they are made as slots in shielding plate 2 at distal ends 7, 8. They preferably each have a surface of at most 10 $mm^2$ or at most 2 $mm^2$, preferably at most 1 $mm^2$, and quite particularly preferably at most 0.5 $mm^2$, or even at most 0.2 $mm^2$, so that the shielding effect of shielding plate 2 is not impaired.

Plug connector 10 is designed for example so as to be suitable for use for the interference-free transmission of data rates of at least 100 Mbit/s, preferably at least 1 Gbit/s, and quite particularly preferably at least 100 Gbit/s.

Alternatively or in addition, plug connector 10 can be designed so as to be suitable for example for use in high-current applications, for the transmission of electrical currents of at least 10 A or at least 50 A or at least 100 A. In such an application, electrically conductive conductor 31 of electrical cable 30 can for example have a cross-section of at least 1 $mm^2$ or at least 10 $mm^2$ or at least 50 $mm^2$.

What is claimed is:

1. An electrical plug connector for plugging together with a complementary mating plug connector, comprising:

a connector housing for accommodating at least one electrical cable that extends along an axial direction; and a shielding plate that completely encloses the connector housing in a circumferential direction around the axial direction;

wherein the connector housing has, on an external surface, a play-limiting element for limiting a degree of play in the state of being plugged together with the mating plug connector, wherein the shielding plate has an opening, the play-limiting element protruding from the connector housing and extending through the opening of the shielding plate, and/or the play-limiting element being a connector housing opening in the connector housing and being adjacent to the opening of the shielding plate, and wherein the play-limiting element is situated at a first distal end of the connector housing, as regarded along the axial direction, wherein the shielding plate has, at a second distal end situated opposite the first distal end, at least one third opening for accepting a mating connector play-limiting element of a mating connector that is connectable to the plug connector.

2. The electrical plug connector as recited in claim 1, wherein the electrical plug connector has at least one electrical cable that is shielded and is situated in the connector housing, the electrical plug connector being either for: (i) the transmission of data rates of at least 1 Gbit/s, and/or (ii) high-current applications for the transmission of electrical currents of at least 10 A.

3. The electrical plug connector as recited in claim 2, wherein the electrical plug connector is for use for the transmission of data rates of at least 100 Gbit/s.

4. The electrical plug connector as recited in claim 1, wherein the connector housing has on an external surface an additional play-limiting element, situated at the same distal end as the play limiting element, for limiting a degree of play in the state plugged together with the mating plug connector, and wherein (i) the shielding plate has an additional opening, the additional play-limiting element protruding from the connector housing and extending through the additional opening of the shielding plate, and/or (ii) the additional play-limiting element is an additional connector housing opening in the connector housing and is adjacent to the additional opening.

5. The electrical plug connector as recited in claim 1, wherein the connector housing is made of plastic or of electrically non-conductive plastic.

6. The electrical plug connector as recited in claim 4, wherein the additional play-limiting element is situated at the first distal end.

7. The electrical plug connector as recited in claim 4, wherein the additional play-limiting element is situated on the connector housing so as to be offset by 160° to 200° relative to the play-limiting element, regarded in the circumferential direction.

8. The electrical plug connector as recited in claim 4, wherein the opening of the shielding plate tightly surrounds the play-limiting element, and the additional opening of the shielding plate tightly surrounds the additional play-limiting element.

9. The electrical plug connector as recited in claim 1, wherein the plug connector has at least one electrical cable that is shielded and is situated in the connector housing, the plug connector being for either: (i) the transmission of data rates of at least 100 Gbit/s, and/or (ii) high-current applications for the transmission of electrical currents of at least 50 A.

10. The electrical plug connector as recited in claim 2, wherein the plug connector is for the transmission of data rates of at least 100 Gbit/s.

11. The electrical plug connector as recited in claim 1, wherein each of the openings in the shielding plate has a surface of at most 10 $mm^2$.

12. The electrical plug connector as recited in claim 1, wherein each of the openings in the shielding plate has a surface of at most 2 $mm^2$.

13. The electrical plug connector as recited in claim 1, wherein each of the openings in the shielding plate has a surface of at most 1 $mm^2$.

14. The electrical plug connector as recited in claim 1, wherein each of the openings in the shielding plate has a surface of at most 0.5 $mm^2$.

15. The electrical plug connector as recited in claim 1, wherein each of the openings in the shielding plate has a surface of at most 0.2 $mm^2$.

* * * * *